US006398082B2

(12) United States Patent
Clark et al.

(10) Patent No.: US 6,398,082 B2
(45) Date of Patent: Jun. 4, 2002

(54) ACTUATOR MECHANISM

(75) Inventors: Norman Clark; Andrew Claughton, both of Leeds (GB); Karen Michelle Dickinson, New South Wales (AU); Adalberto Geier, Villazzano (IT); Nigel Laurence Jackson, Peterborough (GB); Gunter Walter Kolanus, Niedernhausen (DE); Richard Paul McNabb, Wirral; Ian Stuart Midgley, Leeds, both of (GB)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 0 days.

(21) Appl. No.: 09/783,495

(22) Filed: Feb. 14, 2001

(30) Foreign Application Priority Data

Feb. 14, 2000 (GB) ..... 0003343

(51) Int. Cl.[7] ..... B65D 83/46; B65D 83/22

(52) U.S. Cl. ..... 222/402.11; 222/153.11; 222/402.13; 222/402.21

(58) Field of Search ..... 222/153.11, 153.13, 222/402.11, 402.13, 402.21, 505, 511

(56) References Cited

U.S. PATENT DOCUMENTS

| | | | | | |
|---|---|---|---|---|---|
| 3,169,672 | A | * | 2/1965 | Soffer et al. | 222/153.11 |
| 3,429,483 | A | * | 2/1969 | Micallef | 222/153.11 |
| 3,828,982 | A | | 8/1974 | Steigerwald | |
| 3,858,762 | A | * | 1/1975 | Meshberg | 222/180 |
| 4,325,497 | A | * | 4/1982 | Ewald | 222/153.11 |
| 4,328,911 | A | * | 5/1982 | Knickerbocker | 222/182 |
| 4,333,589 | A | | 6/1982 | Bush | |
| 5,139,180 | A | | 8/1992 | Lucas | |
| 5,263,616 | A | | 11/1993 | Abplanalp | |

FOREIGN PATENT DOCUMENTS

| | | |
|---|---|---|
| DE | 33 42 884 | 11/1983 |
| GB | 1210875 | 11/1970 |
| GB | 1475467 | 5/1974 |
| WO | 86/01787 | 3/1986 |

* cited by examiner

*Primary Examiner*—Joseph A. Kaufman
*Assistant Examiner*—Stephanie Willatt
(74) *Attorney, Agent, or Firm*—Matthew Boxer

(57) ABSTRACT

In the present invention, an actuating mechanism for a hand held canister is provided in which a slider is moveable by finger pressure from a valve-disengaged position into a valve-engagable position and a concealed spring returns the slider to a valve-disengaged position when finger pressure is removed. The spring is preferably molded with the slider, projects through a slit in the over-cap of the canister and acts in a vertical plane against a stop depending from the over-cap. It is energised when the slider is moved into the valve engagable position. The slider is preferably releasably locked in the valve disengaged position.

26 Claims, 10 Drawing Sheets

ACTUATOR MECHANISM

The present invention relates to an actuator mechanism and in particular to a mechanism for actuating an aerosol container which is moveable from an inoperable to an operable position.

Aerosol containers represent very convenient means to dispense a range of substances, often in the form of powders, foam or a spray of fluid droplets. Moreover, they are particularly hygienic to operate. It has hitherto been recognised that during transportation, display before purchase and storage after purchase, it is desirable to employ a mechanism to prevent accidental discharge of the container contents, and conveniently this can comprise a mechanism which is moveable between a first and second position. In the first position, the mechanism is locked and incapable of operating the actuator and in the second position engages with the aerosol actuator and is capable of operating it.

A number of proposals have been made since the introduction of aerosol containers in which an over-cap or slider is moveable from a disengaging to an engaging position. For example, in U.S. Pat. No. 2,678,147, a slider fitting over the actuator has a base profile which rests on a shoulder surrounding a plunger in the inoperable position, and is slid forwards to an operable position in which the slider base rests on the plunger and is spaced above the shoulder allowing depression of the slider. However, the slider remains in the operable position unless the user manually returns the slider to an inoperable position. Secondly, it will be recognised that during transportation of such an aerosol canister, for example in a handbag or pocket, there is no restraint on movement of the slider inadvertently into an operable position, so that a significant risk of accidental discharge remains.

In U.S. Pat. No. 3,734,353, there is described an actuator over-cap in which in the inoperable position, a button rests on a tab formed in the wall of the over-cap. In operation, the button is slid forward beyond the edge of the tab and over the aerosol valve, so that the button can now be depressed. As in U.S. Pat. No. 2,678,147, the button must be returned manually from its operable to its inoperable position.

In U.S. Pat. No. 3,967,760, there is a further variation in which the slideable member comprises a button which is hinged horizontally to a carriage resting on the over-cap wall. The button is slideable from an inoperable position in which it rests partly on a tab projecting inwardly from an over-cap wall to an operable position in which the button after disengagement from the tab can be rotated about the hinge. The hinge is unable to return the button into an inoperable position.

In U.S. Pat. No. 4,815,541, a fire extinguisher is described which has a lever that is depressed to open the flow valve, and a removable collar which prevents depression of the lever until its removal. Once the collar has been removed, the extinguisher remains operational.

In U.S. Pat. No. 4,328,911 there is described a child resistant assembly in which a finger actuator is rotatably mounted relative to the actuator, into a selected relative position where depression of the finger actuator depresses the actuator. No mechanism is provided for returning the finger actuator to an inoperable position.

In U.S. Pat. No. 5,263,616, there is disclosed an aerosol canister in which the actuator opens and closes a tilt valve, the actuator being linked with torsion hinges to the cap for the actuator. However, in the rest position, the actuator is not locked and can therefore engage the valve at any time.

In U.S. Pat. No. 4,679,712, there is described a dispensing pump comprising an actuator button that can be slid manually from a locked position to a position where it can be depressed, opening an outlet valve. No mechanism is provided for returning the actuator button to its locked position.

In U.S. Pat. No. 4,848,595, there is described a product dispenser in which a locking ring is rotatable from a position in which an actuator is locked to a second position in which it is unlocked. However, there is no mechanism described which returns the locking ring to the locked position.

Likewise, in U.S. Pat. No. 5,158,206, there is described a cover member rotatably mounted on a tubular body which is mounted over the valve of an aerosol canister. The cover member rotates from an operative to a non-operative position, but no means is provided to return to a non-operative position.

In two related U.S. Pat. Nos., 4,333,589 and 4,442,955, there is described a child-resistant over-cap for an aerosol can in which the over-cap includes an integrally molded and deformable web (acting like a spring) that is hinged and functioning as a guard and can be rotated to overlay the valve stem. The web is provided with a small backwards-facing hinged flap, that can be positioned over the valve stem to open the valve by depressing and rotating the flap. The depression of the flap must occur simultaneously with pushing the web forwards. However, there are several intrinsic deficiencies in such a design as described. First, the rotatable flap is only narrow, having a maximum diameter of about 12 mm in the context of typical cosmetic aerosol cans having a can diameter of about 60 mm or less. The flap diameter cannot be widened without intrinsically weakening the side-arms in the guard section of the web. Consequently, the mechanism as described is not suitable for use by the substantial fraction of the target user population for aerosols, namely adults who typically have wide fingers. The design also runs the risk of trapping a finger between the flap and the guard.

Secondly, single finger operation in such a design is either impractical or at best very difficult. That is because back hinging of the flap is contrary to the hinging of finger joints, which curl the finger tip towards the palm of the hand when exerting finger pressure. Accordingly, it is comparatively difficult for a finger to rotate the flap below the plane of the guard, whilst at the same pushing the web forwards with the same finger. The problem is exacerbated for persons having long finger nails because they hinder a finger tip sliding down the face of the flap and suffer a significant risk of them being broken during operation.

Thirdly, the web is external to the over-cap and consequently is exposed and at risk of being damaged by impact during transportation or display of the aerosol.

In DE-A-3342884, there is described a protective cap for an aerosol having an actuating member which can be moved approximately horizontally and longitudinally between a position in which it overlaps the can spray valve and thereby can open the valve to a rest position in which it cannot open the valve. In accordance with the text and figures, the actuating member is returned to the rest position by a complex H-shaped leaf spring arrangement that comprises a pair of curved leaf springs providing a single bridge between two parallel leaf springs attached at each end to the over-cap. The curved leaf springs contact the actuating member and act predominantly in a plane which is transverse to the motion of the actuating member and the parallel leaf springs act by bowing, thereby likewise again acting predominantly in the transverse plane. The power which such a spring arrangement can develop is constrained by the limited travel available inside an over-cap. Moreover, it is only elastic deformation which generates spring power. When a leaf spring is bent beyond a contact angle of 90°, as illustrated in FIG. 12 of '884, it has passed into the zone of plastic deformation. As a result, the spring does not return to its rest position before deformation, but falls short to the extent that it has been plastically deformed. Hence, the actuating member is not returned all the way to its rest position. There is accordingly a significant risk that after the aerosol has been used once or twice, the actuating member will remain sufficiently over the valve to keep the valve open when hand pressure is removed. On the other hand, if the thrust from the curved springs initially is large, there is a risk that the spring arrangement will be unseated from the over-cap.

The actuating member is located within the over-cap by means of two symmetrical pairs of transverse horizontal lugs projecting from the member into two horizontal channels cut into the parallel longitudinal side-walls of a well in the top of the over-cap overlying the valve. There are, however, practical difficulties in adopting the depicted system in mass manufacturing. The tolerances for the lengths of the lugs are small, as is the tolerance for the width of the actuating member relative to the width of the well. If the lugs are too long, it requires considerable force to insert them into the channels, with the further risk that one or more might be snapped off during the insertion, whereas if they are too short, or the gap between the actuating member and the sidewall of the well is too great, there is a significant risk that they could be pushed or twisted out of the channels during movement of the actuating member, thereby preventing the member from sliding in the desired direction.

The leaf spring is not attached to the actuating member but contacts a transverse lug that depends from the base of the member. The lug of the actuating member is intended to slide vertically past the leaf spring when the valve is closed by depression of the member, but at that point in time the spring is fully compressed, maximising frictional engagement between the lug and the spring, thereby increasing the risk of the actuating member being twisted and one or more locating lugs being disengaged from the channels in the well sidewall.

A number of patents or applications have described over-caps for aerosol containers in which all the elements of the over-cap and actuating mechanism are integrally molded together. For example, in WO 86/01787, there are described several alternative ways of arranging the over-cap, and the actuating means so as to enable a user to bring the actuator to a position in which a discharge valve can be opened and thereafter return the assembly to a position in which the discharge valve cannot be opened. All the ways described therein share the concept of integral molding of the over-cap and actuating mechanism. Similarly, in WO 98/11001, there is described a spray cap for an aerosol container in which an actuating button and an actuating lever 3 are integrally molded with a housing 1.

Whilst the concept of integrally molding the housing element in a spray cap with the actuating button and actuating lever may be superficially attractive, for example a one piece assembly compared with assembling a number of individual constituent parts, it will require a complex molding operation that will be relatively difficult to control and relatively expensive to make. Moreover, the very nature of such an integral molding denies the manufacturer the option of choosing different materials for the different elements in the over-cap, and thereby selecting and employing each material with its range of physical properties which is best suited for each element individually.

Various patents concentrate on so-called child-proof dispenser assemblies for aerosols. Many of these involve a series of operations before the discharge valve can be opened, and some include the possibility, as in WO 86/01787 of at least part of the actuator assembly being returned automatically to a position in which the valve can be opened. The presence of additional assemblies intended to deter children from using the aerosol not only renders the aerosol more difficult and hence less attractive to use, but also makes it more expensive to manufacture. In essence, a child-proof feature causes over-engineering of the dispenser that detracts from its consumer appeal.

For example, U.S. Pat. No. 4,024,995 requires a user to grasp the over-cap between thumb and ring/little fingers whilst placing the forefinger vertically along a channel extending longitudinally on the top of the over-cap and depressing an actuator vertically when a guide block has been moved sufficiently along a transverse channel by the middle finger. Whilst such an arrangement might be effective at preventing the aerosol from being discharged accidentally, it is cumbersome and awkward.

Some operating instructions require the actuator mechanism or the cap to be rotated relative to each other before the discharge valve can be opened, as for example in U.S. Pat. No. 3,924,782. Incorporation of relative rotational movement in safety closure assemblies can be very effective at preventing accidental discharge, but it commonly requires both hands for operation. Single handed operation is much more convenient.

It is an object of the present invention to provide an actuator mechanism for an aerosol can which can be moved from an inoperable rest position to a valve-opening position by finger pressure and returns to the rest position when the finger pressure is removed, which mechanism avoids or ameliorates one or more of the disadvantages of actuator mechanisms described hereinbefore.

It is a further object of at least some advantageous embodiments of the present invention to provide an actuator mechanism employing a concealed simple spring system to return the actuator to a locked rest position.

It is a yet further object of some preferred embodiments of the present invention to provide an actuator mechanism which is locked at its inoperable rest position, but releasable manually.

It is a still further object of the present invention, in at least some or other of its embodiments, to provide an actuator mechanism which prevents accidental discharge of an aerosol that can be held in one hand but which can be moved to an operable position simply and conveniently using a single finger.

It is a yet further object of at least some or yet other embodiments of the present invention to provide an over-cap for a hand-held aerosol which is aesthetically pleasing.

In yet another object of various embodiments of the present invention, potentially related to the aesthetic virtues of the over-cap, only a finger plate of the actuator mechanism is exposed outside the over-cap.

According to the present invention, there is provided an actuator mechanism for a hand-held aerosol container which container is fitted at its top centrally with a dispensing valve which mechanism comprises a cup-shaped over-cap lockably attachable to the container and comprising a sidewall defining a spray aperture through which a spray can be directed and a topwall defining a longitudinally-extending slit pointing towards the spray aperture in the sidewall;

a spray channel in fluid connection with the valve and adapted to direct spray through the aperture in the sidewall of the over-cap;

a slider which is moveable by finger pressure along the longitudinally-extending slit towards the spray aperture from a valve disengaged position to a valve-engagable position, which slider has a finger-plate projecting above the topwall and a keel which depends from the finger-plate through the longitudinally extending slit and is profiled to contact and depress the spray channel and thereby open the valve by movement of the slider into the valve-engagable position, optionally after depression of the slider;

and a spring, operating in the vertical plane of the longitudinally extending slit, which engages the over-cap or spray channel and is energised when the slider is moved to the valve-engaging position, and when finger contact is removed, urges the slider towards the valve disengaged position.

The actuating mechanism according to the present invention advantageously can be used by all potential users of body sprays, including adults having typically sized fingers, and teenagers. The invention mechanism enables the spring-return mechanism to be enclosed and protected within the over-cap. Particularly advantageously, the actuating mechanism can be employed in conjunction with currently available aerosol containers such as those made from aluminium or tin-plate, either without modification of the canister or alternatively by a simple reprofiling of the top of the container during forming operations to provide a lateral partial or complete annular groove or rib to engage the over-cap.

Herein "vertical" relates to when the dispenser is in an upright position, i.e. an axis extending from its base to its top.

A beneficial feature of the actuating mechanism of the present invention is that it is a physically separate element from the over-cap and not integrally molded with it. This enables the manufacturer to select the most appropriate materials for each of the elements of the over-cap and actuator mechanism and not make compromises in trying to use the same material for all elements. A related beneficial feature of the present invention is that the finger plate is a physically separate element from the spray channel and not integrally molded with it.

A yet further beneficial feature of the present invention is that the finger plate is the only part of the actuator mechanism that is outside the over-cap. This enables the aerosol to present a clean and aesthetically attractive appearance, whilst retaining the desired function of preventing accidental discharge. Such an arrangement not only conceals but also protects the mechanism for returning the actuator to a non-operative position.

DETAILED DESCRIPTION

The over-cap in the actuating mechanism is lockably attachable to the container. Commonly, the over-cap itself comprises means for its lockable attachment to the canister, often acting in conjunction with a co-operating means on the canister. Such means may comprise facing lateral ribs or a co-operating lateral rib and groove on the over-cap and canister. The location of the attachment means is at the discretion of the manufacturer, and the choice is often made in the light of whether a one piece or two piece canister is employed. Two variations are particularly favourable, namely attachment to the sidewall of the canister where it contacts the sidewall of the over-cap or attachment to the valve cup of the canister, desirably to an inner side wall depending from the topwall of the over-cap and dimensioned to engage the valve cup when the over-cap sidewall contacts the canister sidewall. The attachment means are intended to prevent physical separation of container and over-cap. Some lateral rotational movement of over-cap relative to the canister may sometimes arise.

Where the co-operating attachment means are on the sidewall of the canister, they preferably comprise an inward facing lateral rib at or near the base of the over-cap side wall which may or not be continuous, that engages with a co-operating lateral rib or groove on the container to attach the two parts together. Preferably the co-operating lateral means are not continuous. A two piece canister conveniently provides an annular rib where its sidewall is joined to its topwall. In a one-piece canister, a suitable outward facing rib can be obtained by forming the metal. The co-operating attachment means on the over-cap for such an annular rim and groove on the container can comprise an inward -facing continuous or broken annular rib on the inner face of the over-cap at or adjacent to the base of its sidewall. The rib is preferably scarp profiled, the gentle slope extending towards the base. Less commonly, a reverse means for attachment could be employed, having a suitably profiled groove in the sidewall of the over-cap and an outward-facing scarp-profiled rib on the container.

Where the attachment means engage the valve cup, the over-cap can comprise an inner sidewall extending downwardly from the topwall and engaging the valve cup in a similar fashion to that described above for attaching the sidewall of the container to the over-cap. Such attachment means can be additionally to or instead of the attachment between the topwall and sidewall of the container. Such an inner sidewall usually is not continuous, but extends only on either side of the spray channel, allowing a gap through which the spray channel may pass or material may be sprayed, and/or a gap through which the spring may pass.

The valve is centrally located at the top of the canister, i.e. within the valve cup. Commonly, the valve is at the center of the top of the canister.

The over-cap often has a shallow indent in its top wall of slightly greater width and similar or slightly greater depth than the finger plate and of suitable length to accommodate the finger plate when it is moved from a valve disengaged position to a valve-engaged position. By so doing, the finger plate is approximately flush with the top surface of the over-cap and is accordingly better protected against accidental damage during storage or transportation of the aerosol.

The indent can be attached on all sides to the topwall of the over-cap. In some highly desirable embodiments, the indent is attached to the topwall along its rear edge (i.e. the edge distant from the spray aperture) and is separated from the topwall along its front and sides edges by a gap. In such embodiments, the front fraction of the indent enjoys vertical flexibility about an axis that is approximately transverse to the longitudinally-extending slit within which the slider moves. This enables the front fraction of the indent to flex downwards under finger pressure as the mechanism approaches the valve-engaged position and to flex upwards when finger pressure is released, thereby contributing to restoration of the mechanism to a valve-disengaged position. If desired, the longitudinally-extending slit can extend to the front edge of the indent, thereby separating the indent into a pair of wings, or can terminate behind the front edge of the indent. The width of the longitudinally-extending slit in the front part of the indent is desirably slightly wider than that of the spray channel which is conveniently located beneath it. In such an arrangement, the indent is not snagged on the spray channel when the form is flexed downwards.

The over-cap can additionally be formed in co-operation with the finger plate to provide a lock means releasable by finger pressure when the slider has reached the valve-disengaged position. Conveniently, the lock means can comprise a mating lug and receiver, the one on the slider and the other on the facing surface of the over-cap. Preferably, the lug depends from the slider, normally the underside of the finger plate and the receiver comprises an aperture or dimple in the over-cap, which usually is cut or impressed into the receiver of the top wall. The lug is usually integrally molded with the finger plate. Advantageously, the lock means comprises a pair of mating bosses and receivers, preferably symmetrically positioned and offset from the longitudinal axis extending through the spray aperture. The bosses in the lock means are often positioned towards the rear end of the finger plate and the aperture or dimple in the top-plate correspondingly located in the receiver such that the two parts engage at the rear end of the stroke of the finger plate. In operation, the boss is pushed into the receiver when the finger plate returns to its valve-disengaged position and is urged out of the receiver by finger pressure moving the finger plate towards the spray outlet. Alternatively, the lock means could comprise co-operating boss and threshold bar, the bar replacing the receiver in the foregoing description.

The lock means ensure that the slider remains in its valve disengaged position during transit, such as prior to display and sale or by users when being carried in pockets, handbags or the like. This prevents the accidental discharge of the canister contents, thereby not only minimising waste, but also preventing accidental damage to anything in the vicinity of the canister.

The over-cap can have a flat topwall that is substantially horizontal, i.e., parallel with the base of the dispenser, but in a particularly desirable set of embodiments, the topwall is inclined at an angle to its sidewall, sloping from front to back, front denoting the aperture in the sidewall through which the container contents is sprayed. The angle of inclination to the horizontal is often chosen in the range of from 25 to 400, and in many instances in the region of 30 to 35°. Although the slope may be flat, it is preferably convex (slightly domed), its radius of curvature in many instances being from 5 to 10 times the width of the cap. The slope of the topwall often results in the height of the sidewall at the front of the over-cap being from 4:3 to 5:2 times the height of the sidewall at the back. By sloping the over-cap from front to rear, the natural forward motion of the finger on the finger plate introduces a downward component. The topwall is also preferably slightly rounded transverse to the slope. The over-cap is typically conveniently molded from a thermoplastics material such a polyethylene or polypropylene.

The finger plate typically advantageously comprises on its upper surface at least one transverse ridge, possibly crescent-shaped and/or finger molding and/or presents a high friction surface which can assist the finger to slide the slider forward rather than slip off. A single transverse ridge positioned at the front part of the slider can be useful, especially when employed in conjunction with an indent which is flexible at its front part. A high friction surface can be achieved by surface roughening or by choice of material such as a thermoplastic elastomer. The upper surface of the finger plate is preferably substantially flush with the adjacent upper surface of the topwall of the over-cap, and any transverse ridge or finger molding preferably stands proud of the adjacent topwall.

In the present invention, the actuating mechanism is particularly suited to operating an axially opened and closed valve, wherein the keel(s) of the slider under downward finger pressure on the finger plate depresses the valve. That action is assisted by profiling the base of the keel downwardly from front to back. The actuating mechanism may also be employed in conjunction with a tilt valve and in such circumstances lateral movement of the keel of the finger plate serves to move the top of the valve laterally and thereby tilt the valve. Both of the foregoing alternative actuating mechanisms share the advantage that the valve is not opened until at or near the end of the forward stroke of the finger plate, thereby minimising the risk of spluttering or other forms of restricted discharge of the canister contents whilst the finger plate is being pushed forward, and similarly on the return stroke.

In a further alternative mechanism, forward motion of the finger plate alone causes the valve to be depressed and opened. In this alternative, the keel base is profiled downwardly from rear to back, preferably acutely, the difference in the depth of the keel from its front to its rear being sufficient to open the valve. The angle is often from 10 to 45° to the finger plate. This alternative shares with the second alternative the advantage of not requiring downward pressure in addition to forward motion.

The spray channel is in fluid contact with the valve. In many embodiments, the valve comprises a valve stem projecting above the valve, and for use with such valves, the spray channel normally employs a cup that fits over the valve stem. In other, less common embodiments, the valve presents a recessed cup towards the spray channel and the latter correspondingly provides a male stem. Force applied vertically onto the spray channel depresses the valve, opens the axially opening valve, or in the instance of employing a tilt valve, lateral movement of the spray channel angles and thereby opens the valve.

When the finger plate of the slider is at the valve disengaged position, its lower surface rests upon the shoulders of the over-cap on either side of the longitudinally extending slit and the keel is rearward of the spray channel, not exerting either downward or forward pressure. In consequence, downward pressure of the finger plate does not depress or tilt the spray channel and the valve remains closed. When the finger plate is moved forward towards the valve-engaged position, the keel depending from the finger plate slides into contact with an upper surface of the spray channel above the valve. When the valve is an axially opening valve, the keel is desirably profiled such that continued forward lateral movement of the finger plate, either by itself or in conjunction with depression of the finger plate, exerts downwards force on the spray channel, resulting in downward force on the valve and the opening of the axially opening valve when the valve-engaged position is reached. Correspondingly, when the valve is a tilt valve, the lateral movement of the keel is itself sufficient for tilting the valve and thereby opening it.

The keel depends from the finger plate, normally in a central zone. For use with an axially opening valve, it desirably has a wedge-shaped lower surface in profile, tapering from rear to front, i.e. is deeper at the back. The keel is desirably located beneath the central region of the finger plate and the travel of the finger plate along the longitudinally extending slit is so arranged that the maximum depth of the keel wedge is when the central area of the finger plate is directly over the valve. When the tilt valve is employed, although it is possible to contemplate a wedge-profiled base keel surface, it is normally the forward face of the keel which engages the spray channel or an upstanding member from the valve, so that the front of the keel is normally deep enough to achieve that purpose and in that instance the keel base is often parallel with the slider. The engaging front face of the keel is preferably so positioned beneath the slider so that it can move the valve head laterally about 2–5 mm at the end of the forward stroke of the slider.

Conveniently a single keel may be employed, ideally centrally located. Alternatively two or more keels may be employed. Where a single or central keel is employed, it preferably contacts the spray channel above the valve. Where two keels are employed, they are usually parallel and arranged to contact most preferably a pair of transverse arms projecting laterally and symmetrically from the sides of the spray channel for use in conjunction with an axially opening valve. For use with a tilt valve, the twin keels may likewise contact transverse arms of the spray channel, or the rearward face of the spray channel itself or a lug projecting upwardly towards the top of the over-cap a single lug, or a lug projecting upwardly from the valve itself, eg a lug to the rearward of the stem of the spray channel if it is a female valve.

Surfaces which come into contact during the forward and return strokes of the finger plate can, if desired, be made from a low friction material such as PTFE (polytetrafluoroethylene) or treated with a lubricant, such as PTFE or silicone oil spray. Such surfaces include particularly the base of the keel and the contacted surface on the spray channel, and also a ramp and follower, described in more detail hereinafter.

In some embodiments, desirably, the actuating mechanism employs forward movement of the finger plate accompanied by depression at the end of its forward stroke, the over-cap further comprises an inclined ramp, which advantageously is parallel with and spaced below the or each longitudinally extending slit that is located forward of the location of the valve. The ramp preferably terminates at its front end in a well located ideally beneath the front of the finger plate when the slider is in the valve-engagable position. Preferably, the base of the well does not come into contact with any lateral arm of the spray channel.

In embodiments in which the over-cap comprises such a ramp, the slider comprises a follower, such as a plate which depends from the finger plate and advantageously is molded or affixed to the underside of the finger plate, forward of the keel or keels. When the finger plate is slid forwards, the follower plate rides up the ramp, and when it reaches the well, the keels are located directly above the valve or its sidearm. Consequently, when the forward plate drops into the well, the keels move downwards, depressing and opening the valve. Such an arrangement is particularly advantageous, because the follower rests on the ramp, and prevents the valve from being opened when the slider has been moved only partially towards the valve-engagable position, thus, eliminating or reducing the risk of the canister inadvertently being discharged when it is being carried in luggage or a hand-bag.

The rear face of the follower plate is often inclined backwardly, for example in the region of 25 to 45° to the perpendicular from the finger plate in order to assist the plate to be pulled out of its well. The rear edge of the well is advantageously radiused to permit the follower plate to slide more easily out of the well when pressure on the finger plate ceases.

Although it is convenient to employ a single ramp and follower, it is possible alternatively to employ two or maybe three parallel ramps and followers. Especially desirably, when both a keel or keels and a follower or followers are employed on the finger plate, the number of each is chosen such that keel and follower are pointing along parallel axes, for example by employing a single follower and twin keels.

In embodiments of the invention where the finger plate does not comprise a follower that is intended to drop into and be pulled out of a well, the keel or keels, preferably at their base, are profiled such that lateral movement of the finger plate into vertical or horizontal contact, as the case may be, with the valve not only causes the keel to engage with the valve or its side-arms, but also depress or tilt the valve to the extent necessary to open it. Where an axially opening valve is employed in such circumstances, i.e. without a clear downward movement at the forward end of the stroke of the slider, it can be preferably to use a valve with a short stroke, such as below 0.4 mm, e.g. 0.2 mm.

An essential constituent part of the actuator mechanism of the present invention comprises a spring that operates in the plane of the longitudinally extending slit and in practice most desirably in the vertical plane. In many desirable embodiments, the spring comprises a leaf spring which is configured such that both ends of the spring are spaced apart when the slider is in the valve-disengaged position but are brought closer to each other, thereby energising the spring by movement of the slider towards the valve-engaged position.

In particularly desirable embodiments, the spring is integrally molded at one end either a) with the slider, and especially the finger plate thereof, or b) with the spray channel or over-cap. In such embodiments, the spring can be molded from optimum materials, which are potentially comparatively expensive, without requiring the same materials to be employed for the remainder of the actuator mechanism and the over-cap. When the spring is integrally molded with the finger plate, the spring extends though the longitudinally extending slit. At or adjacent to its other end, the spring is usually free, that is to say that it is not fixed to any other part of the package, but instead rests against a constraint. The constraint comprises a suitably opposed surface on either the over-cap, for example a hook or tab depending from the underside of the top wall of the over-cap or on the spray channel itself when the spring is molded with the slider or on the slider when the spring is molded with the spray channel or over-cap. The constraint can be located rearward or forward of the point of molding or fixing, provided that forward movement of the slider energises the spring. Although it is convenient to employ a single spring, it is possible to employ two or more springs, each acting in the vertical plane of its longitudinal slit. Two springs may be located in parallel, either forward of or, preferably, rearward of the valve, or alternatively be positioned longitudinally.

It is particularly convenient to mold the spring with the slider or the spray channel, because by so doing, it is possible to employ, if desired, a material for the spring that is different from that employed for the over-cap, and especially one that has high elasticity and/or elastic region. Advantageous materials from which to mold the spring and any part integrally molded therewith include polyoxymethylene (acetal) or polyamide (nylon). It is also possible to employ a spray channel or preferably slider which is molded with the spring, but employing a different material for the spring, i.e. employing a co-molding technique. This is advantageous because it enables the spring to have beneficial elastic properties and the remainder of the slider or spray channel to have desirable strength and resilience. Although the over-cap and slider are separately molded, it can be aesthetically desirable to pigment them similarly, for example black, so that they harmonise together and present a common appearance to the consumer.

In many especially desirable embodiments, the spring operates to the rearward of the spray channel. It is particularly suitable for the spring to be molded at the rear end of the finger plate. The other end of such a spring is advantageously positioned adjacent to a constraint positioned on the underside of the top surface of the over-cap or the rearward surface of the spray channel. It is particularly beneficial to employ a spring positioned to the rear of the spray channel together with a twin keel, or optionally vice versa, so that the keel and spring can perform their diverse functions without interference.

The or each longitudinally extending slit in the topwall is located and dimensioned so as to allow longitudinal movement of the one or more dependent members from the finger plate, and most conveniently is parallel sided. Such members always include the spring, the keel, which is preferably a twin keel when a single spring is used, and, where appropriate, a follower. The spring and the keel and the follower may be positioned with one linearly behind each other. Preferably, the spring is positioned behind the valve. In other and preferred embodiments, the keel and spring may be laterally offset relative to each other, one being located along the axis extending from the spray aperture to through the valve and the other to one side. Preferably, the one which is offset, for example the spring, is split and disposed symmetrically. In such embodiments, the longitudinally extending slit may be wide enough to accommodate both the spring and the keel, but advantageously, parallel slits are provided, one for each depending member. The width of offset slits to accommodate offset keels is sometimes narrower than that to accommodate the spring.

The slit or slits for accommodating the keel typically extend from behind the valve to a little in front of the valve. Any slit for accommodating the spring may be located either in front of or behind the valve, depending on the point at which the spring is attached to, molded with or restrained by the slider. Desirably the slit or slits are dimensioned just sufficiently to allow the dependent member to pass freely through during the travel of the slider. By minimising the length and breadth of the slits, weakening of the over-cap is kept to a minimum. The over-cap indent can be strengthened in the vicinity of any or all of the slits by thickening its wall.

The spray channel is mounted on top of the valve. Desirably, it comprises a lateral arm which extends towards the over-cap in the vicinity of the aperture, and more preferably further comprises locating means that engage co-operating means on the inner face of the over-cap to attach the spray channel to the over-cap. Suitable locating means comprise a spray head projecting inwardly through the spray aperture and having an inward facing lug which friction fits into an outward facing lateral channel integral with the spray channel. The lateral arm of the spray channel can be approximately horizontal, or if desired can also be upwardly angled towards the spray aperture.

Having described the invention actuating mechanism in general terms, specific embodiments thereof will now be described with reference to accompanying drawings in which:

FIG. 1 comprises an external side and top view of the over-cap from the left hand corner with slider in the valve-disengaged position;

FIG. 1A comprises a variation of the over-cap of FIG. 1 with an extended longitudinally-extending slit.

FIG. 2 comprises a front view of the over-cap of FIG. 1;

FIG. 3 comprises a longitudinal cross-section of the actuating mechanism of FIG. 1, mounted on a canister in part cross section;

FIG. 4 comprises a longitudinal cross-section of the actuating mechanism in FIG. 3 with slider in the valve-engaged position;

Figure 9:
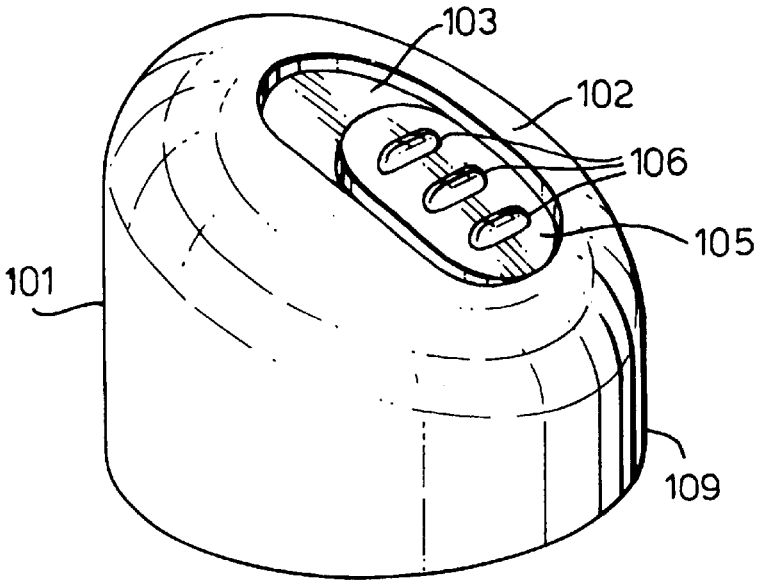
Figure 10:
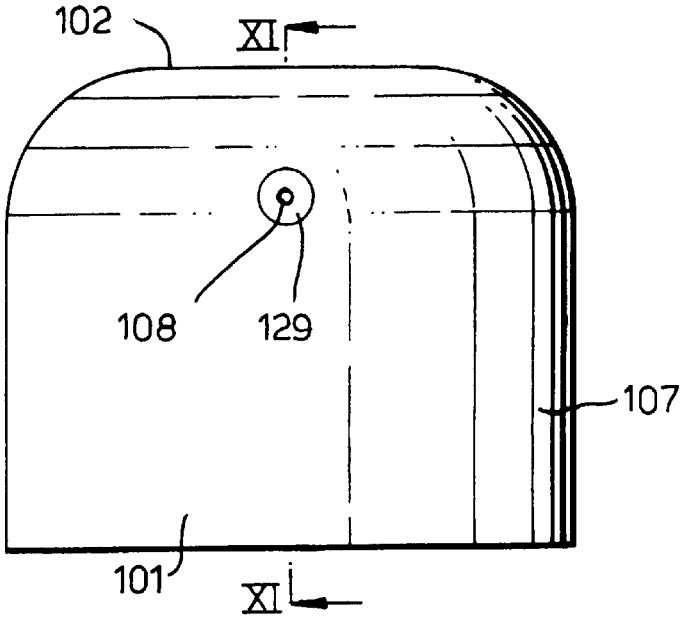
Figure 11:
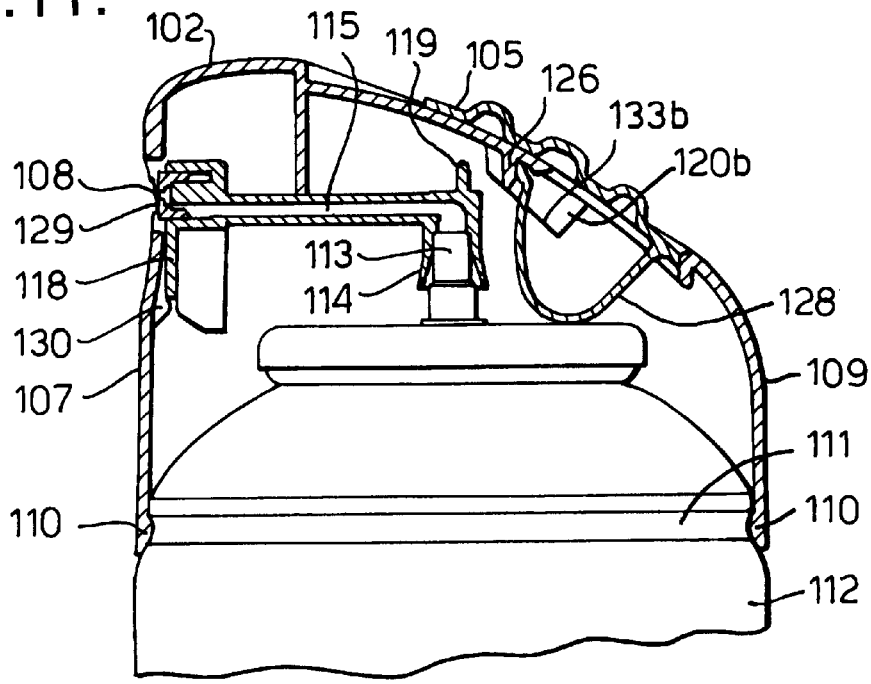
Figure 12:
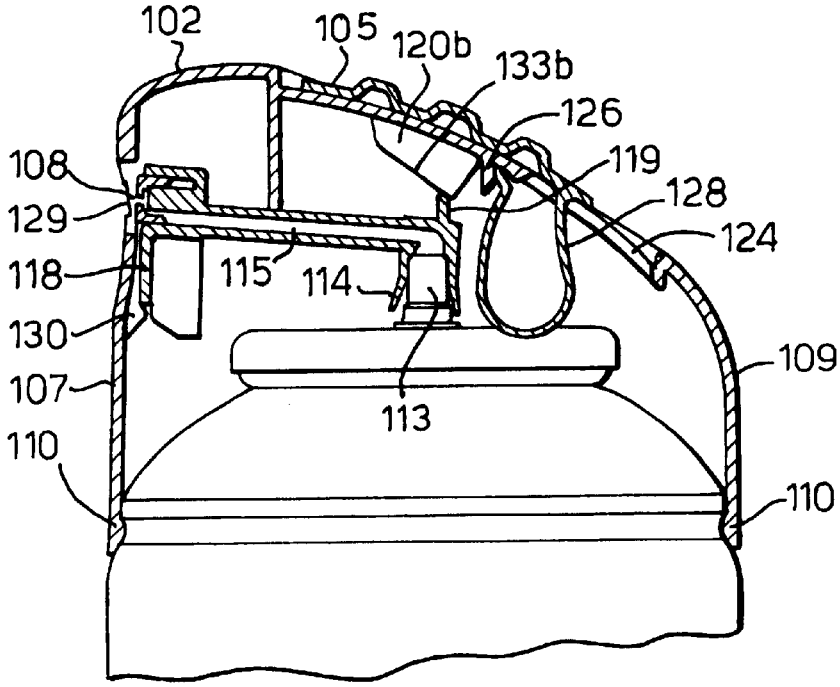
Figure 13:
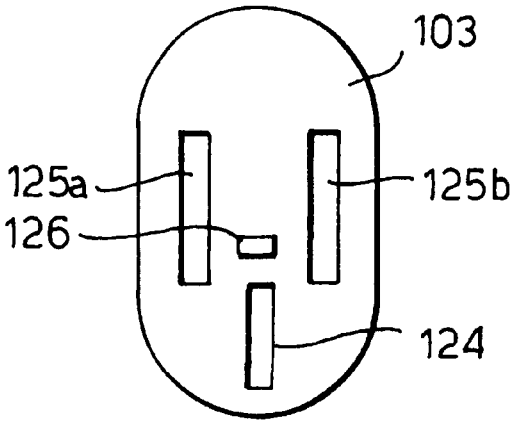
Figure 14:
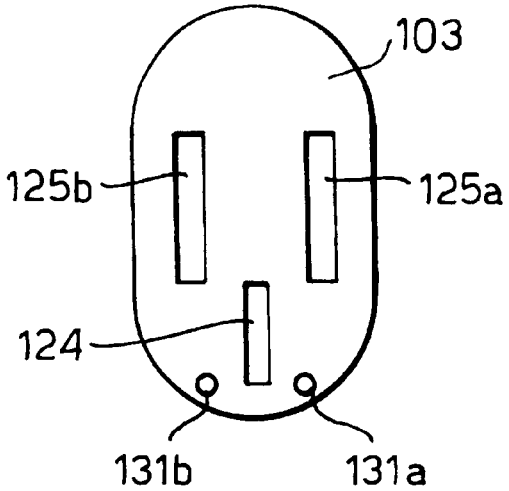
Figure 15:
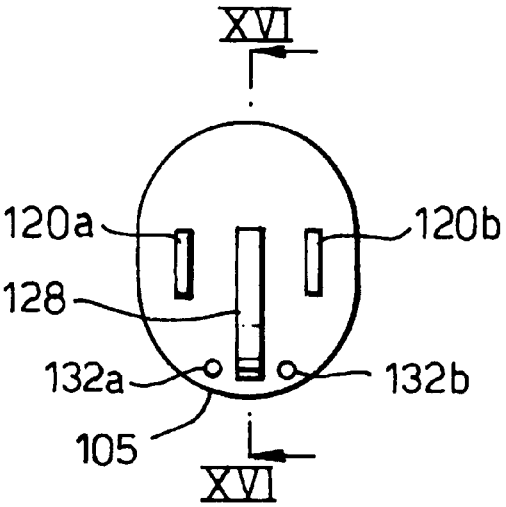

FIG. 9 comprises an external side and top view of an alternative over-cap from the left hand corner with slider in the valve-disengaged position;

FIG. 10 comprises a front view of the over-cap of FIG. 9;

FIG. 11 comprises a longitudinal cross-section of the actuating mechanism for FIG. 9, mounted on a canister;

FIG. 12 comprises a longitudinal cross-section of the actuating mechanism in FIG. 11 with slider in the valve-engaged position;

FIG. 13 is a plan view of the indent in the over-cap of FIG. 9 from its underside;

FIG. 14 is a plan view of the indent in the over-cap of FIG. 9 from above;

FIG. 15 is a plan view from the underside of the finger plate employed in FIGS. 11 and 12

Figure 16:
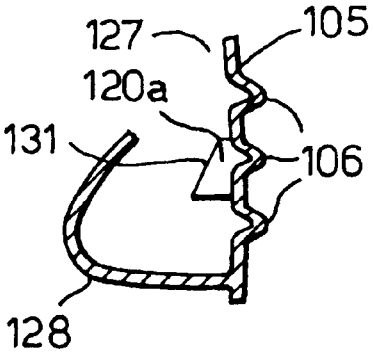
Figure 17:
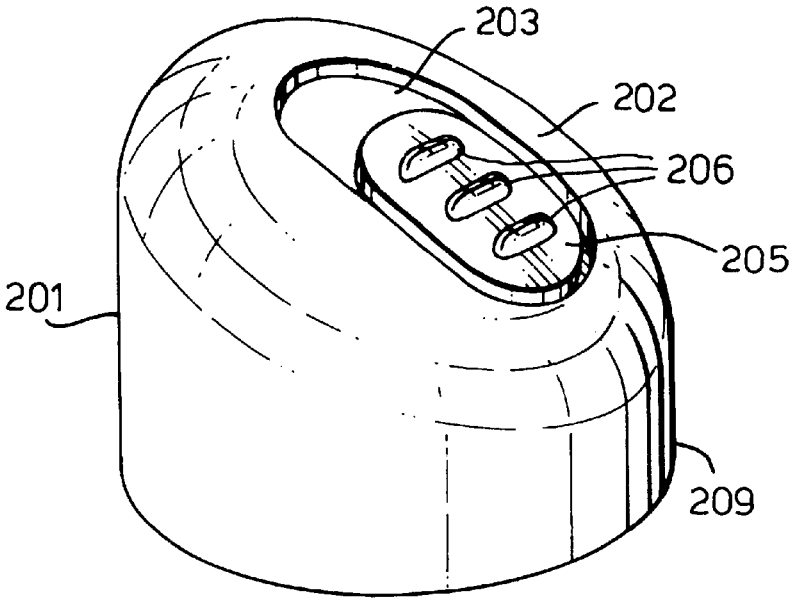
Figure 18:
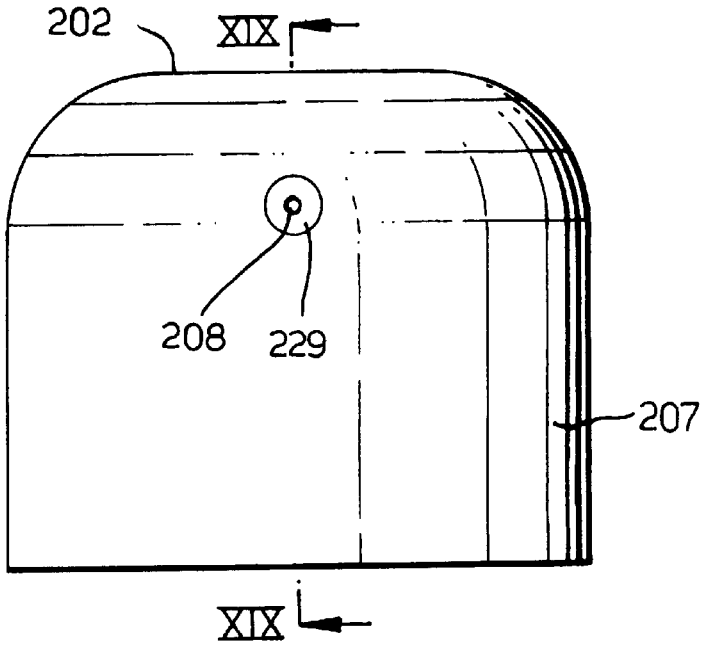
Figure 19:
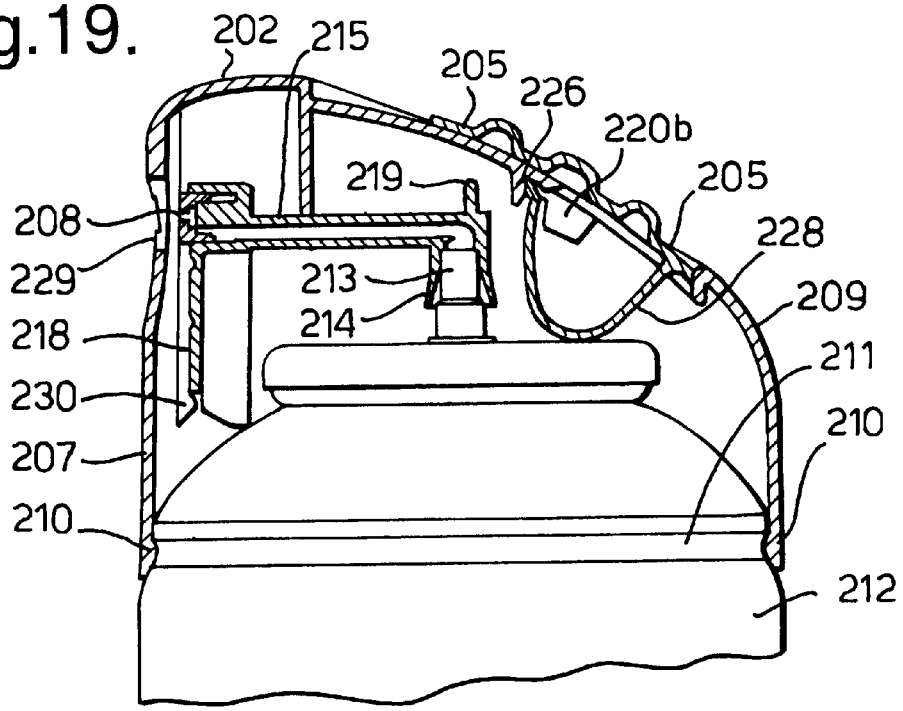
Figure 20:
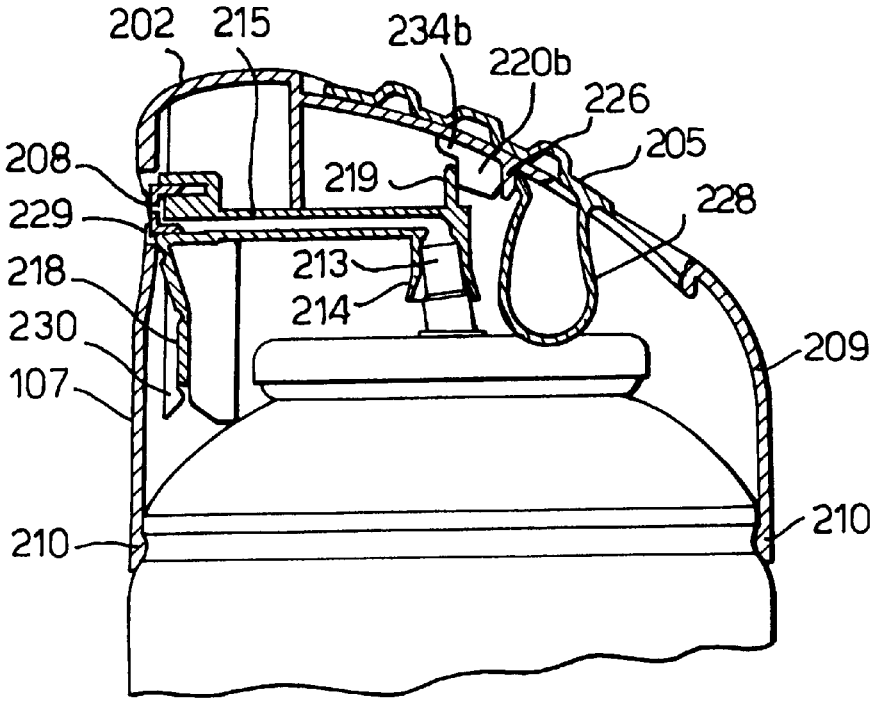
Figure 21:
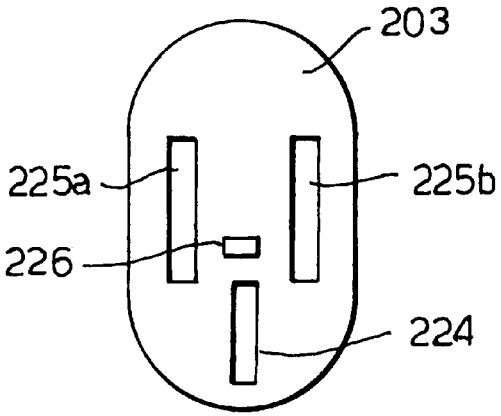
Figure 22:
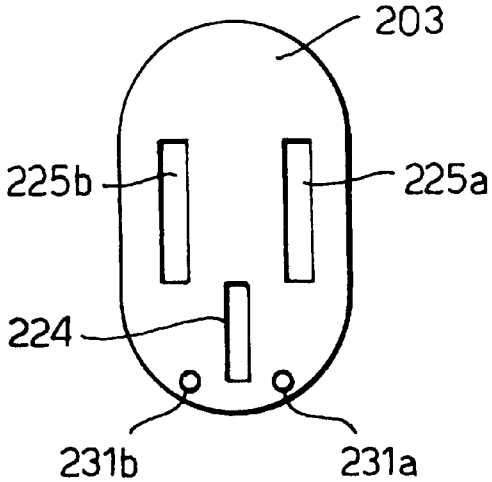
Figure 23:
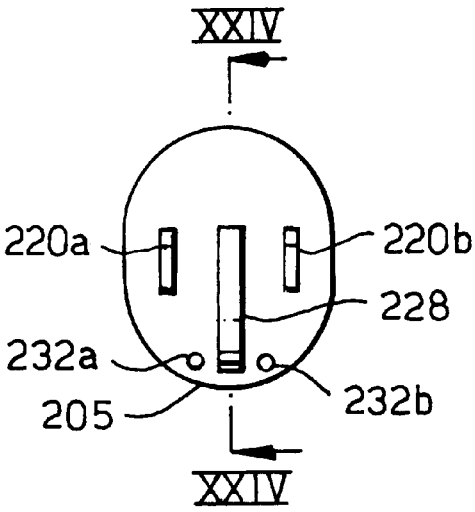
Figure 24:
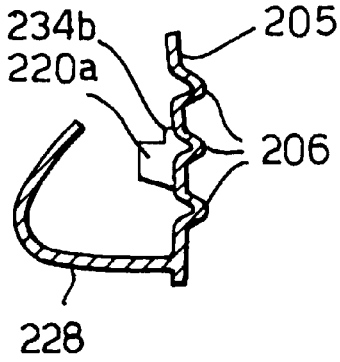

FIG. 16 is a longitudinal cross section through the finger plate of FIG. 15;

FIG. 17 comprises an external side and top view of an over-cap for a tilt valved canister from the left hand corner with slider in the valve-disengaged position;

FIG. 18 comprises a front view of the over-cap of FIG. 17;

FIG. 19 comprises a longitudinal cross-section of an the alternative actuating mechanism for FIG. 17, mounted on a canister;

FIG. 20 comprises a longitudinal cross-section of the actuating mechanism in FIG. 17 with slider in the valve-engaged position;

FIG. 21 is a plan view of the indent in the over-cap of FIG. 17 from its underside;

FIG. 22 is a plan view of the indent in the over-cap of FIG. 17 from above;

FIG. 23 is a plan view from the underside of the finger plate employed in FIGS. 19 and 20;

FIG. 24 is a longitudinal cross section through the finger plate of FIG. 23;

FIGS. 1 to 8

Figure 1:
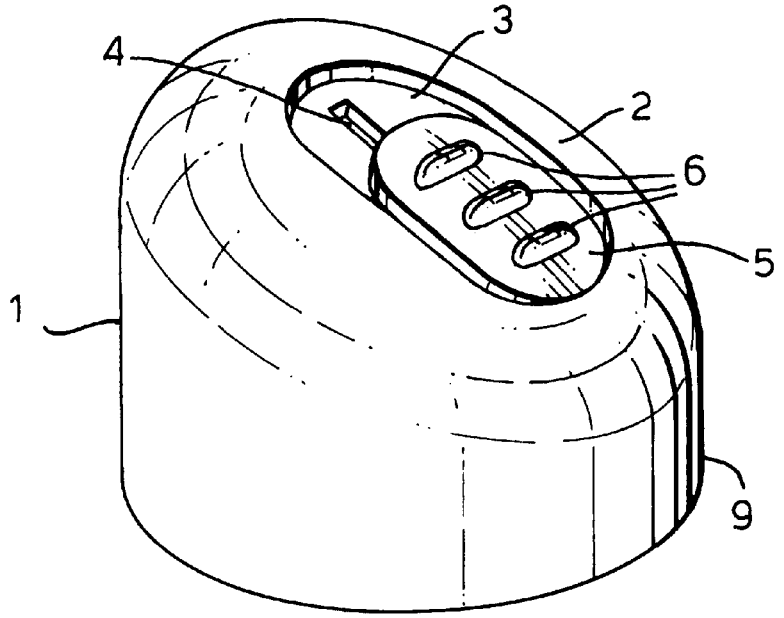
Figure 2:
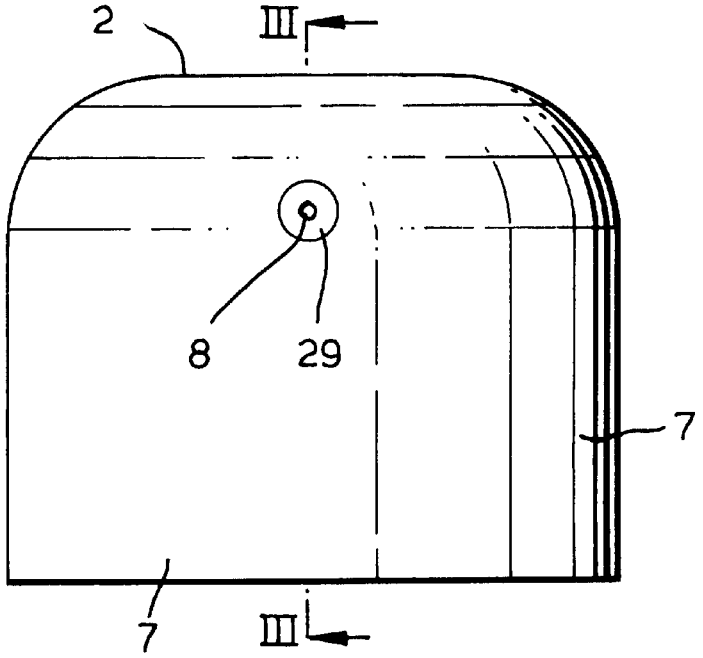

FIGS. 1 and 2 show an over-cap 1 having a top wall 2 inclining from front to rear and defining a shallow lozenge shaped indent 3 in which is molded a longitudinally-extending slit 4. At the rearward end of the indent 3, i.e. in the valve disengaged position, sits a finger plate 5 having three transverse ridges 6. The front wall 7 of the over-cap 1 defines a spray aperture 29 in which is fitted spray head 8. The height ratio of the front wall 7 to the rear wall 9 of the over-cap 1 is approximately 1.7:1.

Figure 3:
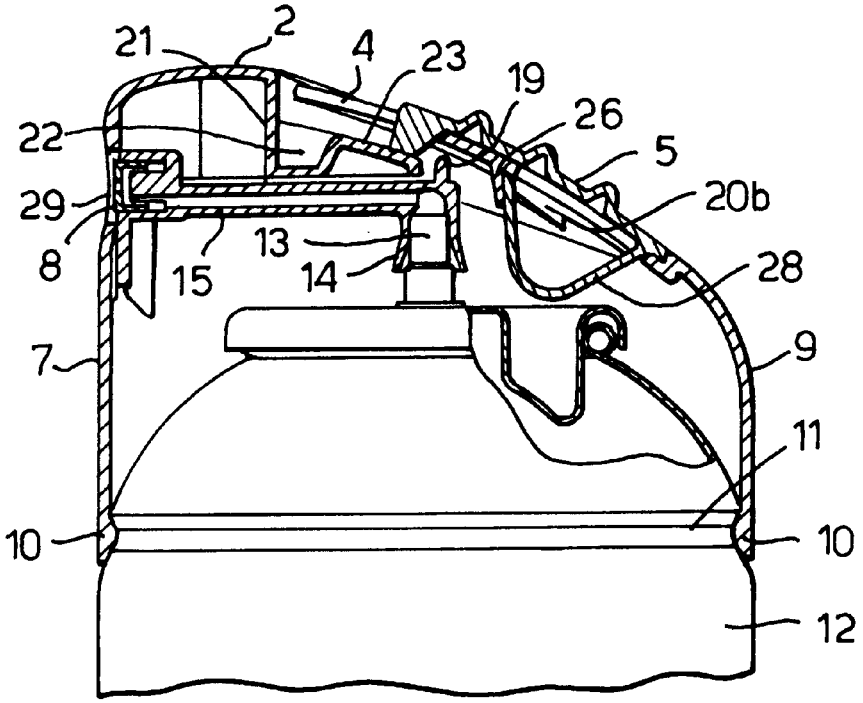
Figure 4:
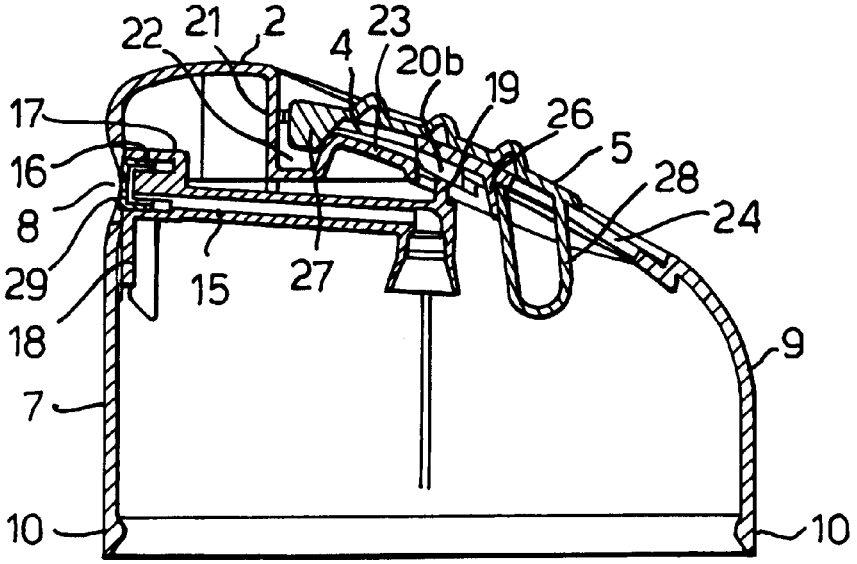

FIGS. 3 and 4 show the over-cap 1 having adjacent to its bottom edge a circumferential ridge 10 which snap fits into a corresponding groove 11 in canister 12. A valve stem 13 is in fluid connection with a spray channel 14 having a lateral arm 15 connected to spray head 8 via inward facing lug 16 frictionally engaging a molded channel 17. The arm 15 has an end flange 18 that co-locates with flanges 30 on the front wall 7 of the over-cap. Spray channel 14 has an integrally molded pair of transverse side-arms 19 each of which come into contact with a trapezoidal keels 20 that is integrally molded with and depends from finger plate 5 in its central area.

A supporting wall 21 extends downwardly from the top wall 2 At the front edge of and below indent 3, and is molded in the form of a well 22 bounded on its rearward side by a ramp 23 that is approximately parallel with the profile of the top wall 2 and ends at the front edge of valve stem 13. Within the bounds of the indent 3, shown in more detail in FIGS. 5 and 6, there are defined four parallel longitudinally extending slits, 4 and 24 lying on the axis of the spray head 8 and valve stem 13, and slits 25*a* and 25*b* symmetrically offset therefrom. A spring locating tab 26 located just forward of slit 24 is inclined backwardly. Towards the rear edge of the indent 3, there are located two dimples, 31*a* and 32*b*, one on either side of the slit 24, for receiving bosses 32*a* and 32*b* respectively.

Figure 5A:
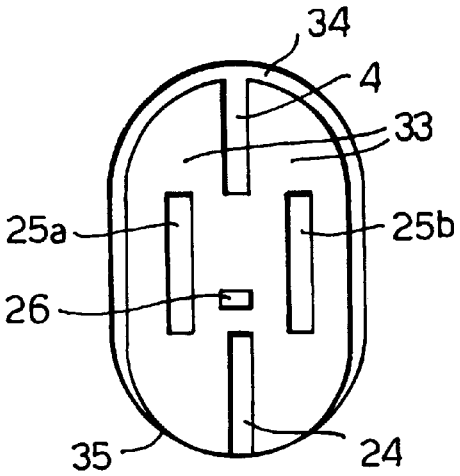
FIG. 5A is a plan view of the indent in the over-cap of FIG. 1A from its underside, showing attachment of the indent at its rear end to the topwall of the over-cap.
Figure 6A:
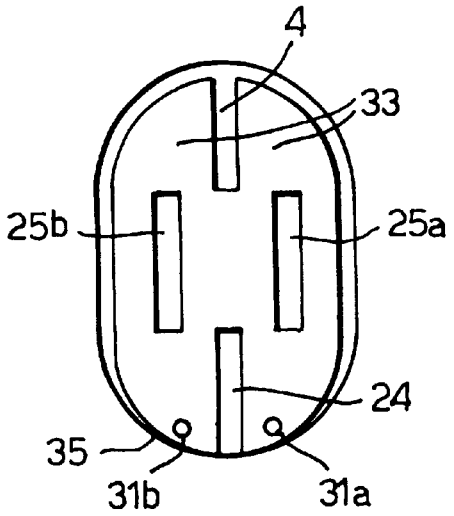
FIG. 6A is a plan view of the indent in the over-cap of FIG. 1A from above, showing attachment of the indent at its rear end to the topwall of the over-cap.
Figure 5:
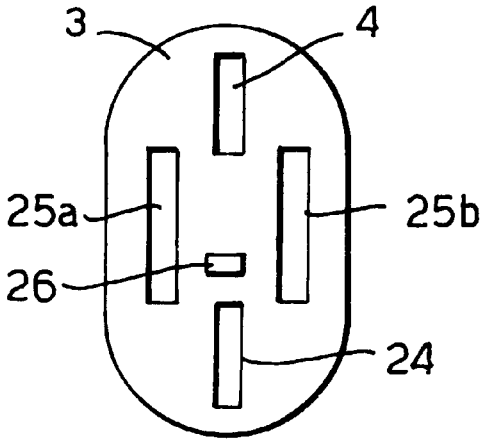
FIG. 5 is a plan view of the indent in the over-cap of FIG. 1 from its underside.
Figure 6:
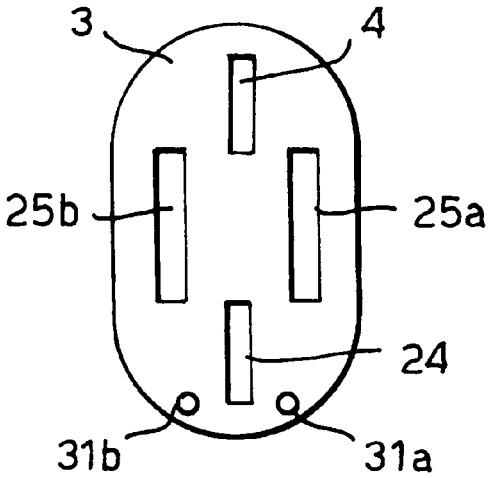
FIG. 6 is a plan view of the indent in the over-cap of FIG. 1 from above.

The indent 3 in the top wall of the over-cap 2 is shown in more detail in FIGS. 5 and 6.

Figure 7:
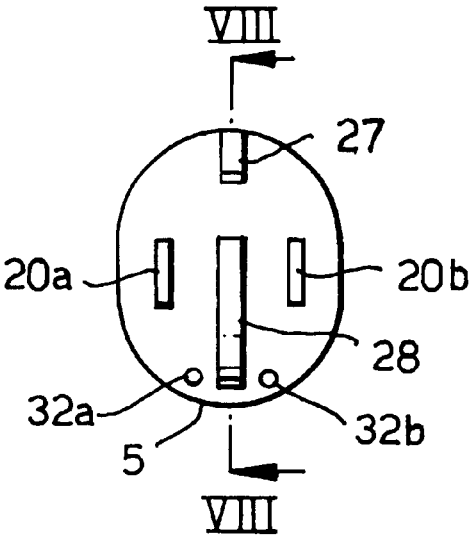
FIG. 7 is a plan view from the underside of the finger plate employed in FIGS. 3 and 4.
Figure 8:
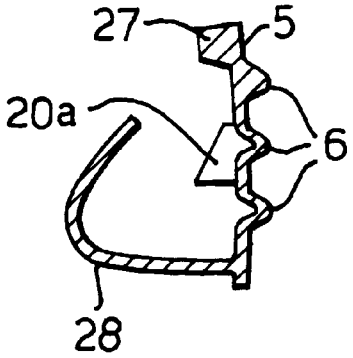
FIG. 8 is a longitudinal cross section through the finger plate of FIG. 6.

The finger plate 5 shown in FIGS. 7 and 8 has integrally molded with it a follower 27 adjacent to its front edge, a leaf spring 28 adjacent to its rearward edge and a pair of offset twin keel 20*a* and 20*b* which fit respectively through slits 4, 24, 25*a* and 25*b* within the indent 3 in the top wall 2 of the over-cap 1. The twin keel 20*a* and 20*b* can have downward sloping nibs (not illustrated) to lock the blades beneath the top wall and prevent the finger plate 5 from being pushed out. The leaf spring 28 at its free end is held by its spring power against tab 26. At its rear end, the finger plate has two protruding bosses 32*a* and 32*b* that mate with receiving dimples 31*a* and 31*b* respectively formed in the top surface of the indent 3.

The actuator mechanism is assembled by inserting the spray head 8 in spray aperture 29, push fitting its inward fitting lug 16 into molded channel 17 on the arm 15. The free end of the spring 28 is inserted through slit 24 and trapped between lug 26 and topwall 2, and the follower 27 and twin keels 20*a* and 20*b* pushed through slits 4, 25*a* and 25*b* respectively. The spring biases the finger plate to the rear end of the indent 3, with the result that the keels 20*a* and 20*b* are behind and out of contact with the side arms 19 on spray channel 14 and bosses 32*a* and 32*b* sit in receiving dimples 31*a* and 31*b* in the indent 3. Resilient downward flanges 30 on the front inner face of front wall 7 on either side of spray aperture 29 co-locate with and form a seating for vertical flange 18 on spray channel 14 underneath spray head 8 to hold the spray head 8 behind the spray aperture 29.

Assembly is completed by push fitting the spray channel 14 onto the valve stem 13 and locking the circumferential ridge 10 into the corresponding groove 11 of canister 12.

In operation, the canister 12 is held generally in an upright manner with a finger resting on the finger plate 5. The finger pushes finger plate 5 forwards against the spring 28, causing the bosses 32*a* and 32*b* to move out of their dimples 31*a* and 31*b*, the follower 27 to slide up the ramp 23, against the action of spring 28 and bringing the twin keels 20*a* and 20*b* into contact with the side-arms 19 on spray channel 14. The spring 28 is compressed against tab 26, energising it. The forward travel of the finger plate 5 is terminated when the follower 27 reaches the point above well 22 and the twin keels 20*a* and 20*b* come into contact with the side-arms 19. Downward pressure on the finger plate 5 causes the follower 27 to drop into well 22, the twin keels 20*a* and 20*b* to depress the spray channel 14, thereby depressing the valve stem 13 and opening the valve.

When finger pressure is removed, the valve operating system closes the valve and lifts the spray channel 14 upwards acting upon the keels and thereby lifting the finger plate 5. The spring 28 acting against tab 26 urges the follower 27 out of well 22 and returns the finger plate 5 to its original, valve disengaged position, whereupon bosses 32*a* and 32*b* engage dimples 31*a* and 31*b*.

Figure 1A:
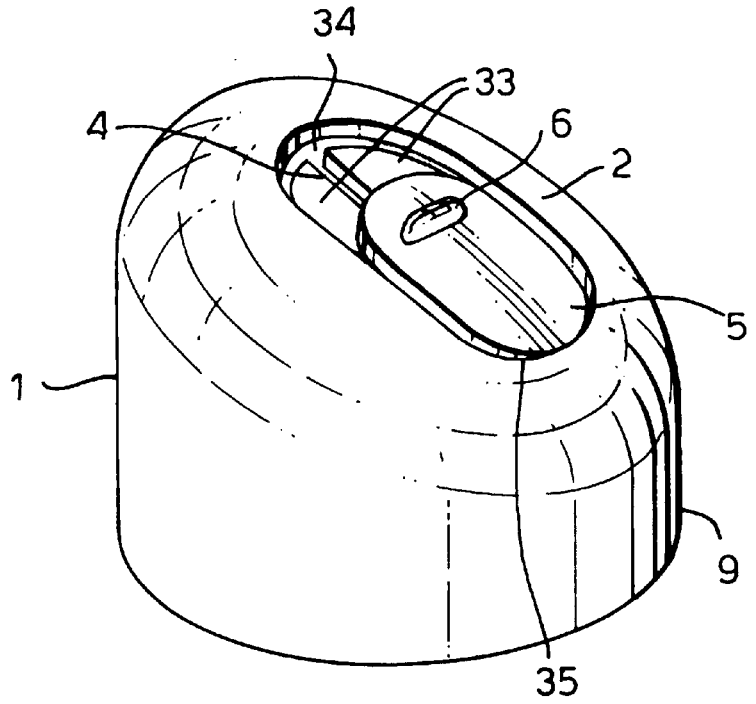

FIGS. 1A, 5A and 6A

These Figures show a variation in the mechanism described in FIGS. 1 to 8, in which the indent 3 is attached to the topwall 2 at its rearward edge 35 and is separated from the topwall along its front and side edges by gap 34. The longitudinally-extending slit 4 extends to the front edge of the indent 3 creating two flexible wings 33. When the finger plate 6 is positioned with the follower 27 above well 22, downward finger pressure on the finger plate 6 flexes the wings 33 downwards in addition to the valve opening described above. On release of finger pressure, the wings 33 seek to return to their rest position and accordingly contribute towards restoring the mechanism to a valve-disengaged position. The presence of a single ridge 6 positioned at the front end of the finger plate 5 positions the finger at the front end of the finger plate 5 so that downward flexing of the indent 3 is encouraged. The rearward longitudinally-extending slit 24 extends to the rear edge 35 of the indent 3. The slits 25*a* and 25*b* to accommodate the keels 20 are narrower than slits 4 and 24, which are of similar width.

FIGS. 9 to 16

FIGS. 9 and 10 show an over-cap 101 having a top wall 102 inclining from front to rear and defining a shallow lozenge shaped indent 103. At the rearward end of the indent 103, i.e. in the valve disengaged position, sits a finger plate 105 having three transverse ridges 106. The front wall 107 of the over-cap 101 defines a spray aperture 129 in which is fitted spray head 108. The height ratio of the front wall 107 to the rear wall 109 of the over-cap 101 is approximately 1.7:1.

FIGS. 11 and 12 show the over-cap 101 having adjacent to its bottom edge a circumferential ridge 110 which snap fits into a corresponding groove 111 in canister 112. A valve stem 113 is in fluid connection with a spray channel 114 having a lateral arm 115 connected to spray head 108 via inward facing lug 116 frictionally engaging a molded channel 117. The arm 115 has an end flange 118 that co-locates with lugs 30 on the front wall 107 of the over-cap. Spray channel 114 has an integrally molded pair of transverse side-arms 119 each of which come into contact with a trapezoidal keel respectively 20*a* or 20*b* which is each integrally molded with and depends from finger plate 105 in its central area.

Within the bounds of the indent 103, shown in more detail in FIGS. 13 and 14, there are defined three parallel longitudinally extending slits, 124 lying on the axis of the spray head 108 and valve stem 113, and slits 125*a* and 125*b* symmetrically offset therefrom. A spring locating tab 126 located just forward of slit 124 is inclined backwardly. Towards the rear edge of the indent 103, there are located two dimples, 131*a* and 132*b*, one on either side of the slit 124, for receiving bosses 132*a* and 132*b* respectively.

The finger plate 105 shown in FIGS. 15 and 16 a leaf spring 128 adjacent to its rearward edge and a pair of offset twin keel 120*a* and 120*b* which fit respectively through slits

124, 125*a* and 125*b* within the indent 103 in the top wall 102 of the over-cap 101. The twin keels 120*a* and 120*b* have sharply profiled bases 133*a* and 133*b* respectively and can have downward sloping nibs (not illustrated) to lock the blades beneath the top wall and prevent the finger plate 105 from being pushed out. The leaf spring 128 at its free end is held by its spring power against tab 126. At its rear end, the finger plate has two protruding bosses 132*a* and 132*b* that mate with receiving dimples 131*a* and 131*b* respectively formed in the top surface of the indent 103.

The actuator mechanism is assembled by inserting the spray head 108 in spray aperture 129, push fitting its inward fitting lug 116 into molded channel 117 on the arm 115 The free end of the spring 128 is inserted through slit 124 and trapped between lug 126 and topwall 102, and twin keels 120*a* and 120*b* pushed through slits 125*a* and 125*b* respectively.

The spring 128 biases the finger plate 105 to the rear end of the indent 103, with the result that the keels 120*a* and 120*b* are behind and out of contact with the side arms 119 on spray channel 114 and bosses 132*a* and 132*b* sit in receiving dimples 131*a* and 131*b* in the indent 103. Resilient downward lugs 130 on the front inner face of frontwall 107 beside spray aperture 129 co-locate with and form a seating for vertical flange 118 depending from spray channel 114 below spray head 108 to hold the spray head 108 behind the spray aperture 129

Assembly is completed by push fitting the spray channel 114 onto the valve stem 113 and locking the circumferential ridge 110 into the corresponding groove 111 of canister 112.

In operation, the canister 112 is held generally in an upright manner with a finger resting on the finger plate 105. The finger pushes finger plate 105 forwards against the spring 128, causing the bosses 132*a* and 132*b* to move out of their dimples 131*a* and 131*b*, and bringing the twin keels 120*a* and 120*b* into contact with the side-arms 119 on spray channel 114. The spring 128 is compressed against tab 26, energising it. Continued forward travel of the finger plate 105 causes the twin keels 120*a* and 120*b* to slide over and push down on the side-arms 119, depressing the spray channel 114, thereby depressing the valve stem 113 and opening the valve.

When finger pressure is removed, the valve operating system closes the valve and lifts the spray channel 114 pushing upwardly on keels 120*a* and 120*b* The spring 128 acting against tab 126 the finger plate 105 to its original, valve disengaged position, whereupon bosses 132*a* and 132*b* engage dimples 131*a* and 131*b*.

FIGS. 17 to 24

FIGS. 17 and 18 show an over-cap 201 having a top wall 202 inclining from front to rear and defining a shallow lozenge shaped indent 203. At the rearward end of the indent 203, i.e. in the valve disengaged position, sits a finger plate 205 having three transverse ridges 206. The front wall 207 of the over-cap 201 defines a spray aperture 229 in which is fitted spray head 208. The height ratio of the front wall 207 to the rear wall 209 of the over-cap 201 is approximately 1.7:1.

FIGS. 19 and 20 show the over-cap 201 having adjacent to its bottom edge a circumferential ridge 210 which snap fits into a corresponding groove 211 in canister 212. A valve stem 213 of a tilt valve is in fluid connection with a spray channel 214 having a lateral arm 215 connected to spray head 108 via inward facing lug 216 frictionally engaging a molded channel 217. The arm 215 has an end flange 218 that co-locates with lugs 230 on the front wall 207 of the over-cap. Spray channel 214 has an integrally molded upstanding transverse lug 219 the rearward face of which comes into contact with the forward face of keels 220*a* and 220*b* which is each integrally molded with and depends from finger plate 205 in its central area. Keels 220*a* and 220*b* have a flat base which is substantially parallel with the finger plate 205 and a strengthening shoulder 234*a* and 234*b* forward of the deeper part of the keel blade.

Within the bounds of the indent 203, shown in more detail in FIGS. 21 and 22, there are defined three parallel longitudinally extending slits, 224 lying on the axis of the spray head 208 and valve stem 213, and slits 225*a* and 225*b* symmetrically offset therefrom. A spring locating tab 226 is located just forward of slit 224 and has a backward facing notch to receive the free end of the spring 228. Towards the rear edge of the indent 203, there are located two dimples, 231*a* and 232*b*, one on either side of the slit 224, for receiving bosses 232*a* and 232*b* respectively.

The finger plate 205 shown in FIGS. 23 and 24 comprises a leaf spring 228 adjacent to its rearward edge and a pair of offset twin keel 220*a* and 220*b* which fit respectively through slits 224, 225*a* and 225*b* within the indent 203 in the top wall 202 of the over-cap 201. The twin keels 220*a* and 220*b* can have downward sloping nibs (not illustrated) to lock the blades beneath the top wall and prevent the finger plate 205 from being pushed out. The leaf spring 228 at its free end is held by its spring power against tab 226. At its rear end, the finger plate has two protruding bosses 232*a* and 232*b* that mate with receiving dimples 231*a* and 231*b* respectively formed in the top surface of the indent 203.

The actuator mechanism is assembled by inserting the spray head 208 in spray aperture 229, push fitting its inward fitting lug 216 into molded channel 217 on the arm 215.

The free end of the spring 228 is inserted through slit 224 and trapped between lug 226 and topwall 202, and twin keels 220*a* and 220*b* pushed through slits 225*a* and 225*b* respectively. The spring 228 biases the finger plate 205 to the rear end of the indent 203, with the result that the keels 220*a* and 220*b* are behind and out of contact with the side arms 219 on spray channel 214 and bosses 232*a* and 232*b* sit in receiving dimples 231*a* and 231*b* in the indent 203. Lug 230 on the sidewall 201 co-locates with flange 218 on spray channel 214.

Assembly is completed by push fitting the spray channel 214 onto the valve stem 213 and locking the circumferential ridge 210 into the corresponding groove 211 of canister 212.

In operation, the canister 212 is held generally in an upright manner with a finger resting on the finger plate 205. The finger pushes finger plate 205 forwards against the spring 228, causing the bosses 232*a* and 232*b* to move out of their dimples 231*a* and 231*b*, and bringing the twin keels 220*a* and 220*b* into contact with the upstanding lug on spray channel 214. The spring 228 is compressed against tab 226, energising it. Continued forward travel of the finger plate 205 causes the twin keels 220*a* and 220*b* to push and rotate the lug 219, rotating the valve towards the spray aperture 208 and opening the valve. On release of finger pressure, the valve spring rotates the valve away from the spray head 208, closing the valve and the spring 228 acting against tab 226 the finger plate 205 to its original, valve disengaged position, whereupon bosses 232*a* and 232*b* engage dimples 231*a* and 231*b*.

Other and further features of these embodiments of the invention mechanism can be seen from the Figures themselves.

What is claimed is:

1. An actuator mechanism for a hand-held aerosol container which container is fitted centrally at its top with a dispensing valve which mechanism comprises a cup-shaped over-cap lockably attachable to the container and comprising a sidewall defining a spray aperture through which a spray can be directed and a topwall defining a longitudinally-extending slit pointing towards the spray aperture in the sidewall, a spray channel in fluid connection with the valve and adapted to direct spray through the aperture in the sidewall of the over-cap, a slider which is moveable by finger pressure along the longitudinally-extending slit towards the spray aperture from a valve disengaged position to a valve-engagable position, which slider has a finger-plate projecting above the topwall and a keel which depends from the finger-plate through the longitudinally extending slit and is profiled to contact and depress the spray channel and thereby open the valve by movement of the slider into the valve-engagable position, optionally after depression of the slider;

and a spring, operating in the vertical plane of the longitudinally extending slit, which, engages the over-cap or spray channel and is energised when the slider is moved to the valve-engaging position, and when finger contact is removed, urges the slider towards the valve disengaged position.

2. An actuator mechanism according to claim 1 characterised in that the spring is a leaf spring.

3. An actuator mechanism according to claim 1 characterised in that the spring at one end is affixed to or integrally moulded with the finger plate and depends through the longitudinally extending slit.

4. An actuator mechanism according to claim 1 characterised in that the spring is integrally moulded with the finger plate and is compressed by forward movement of the finger plate relative to the spray channel.

5. An actuator mechanism according to claim 3 characterised in that the spring is a compression leaf spring affixed to or moulded with the finger plate at or adjacent to its rear edge.

6. An actuator mechanism according to claim 2 characterised in that the spring is compressed against a stop integral with the over-cap or spray channel by forward movement of the finger plate relative to the spray channel.

7. An actuator mechanism according to claim 6 characterised in that the stop comprises a rearward-facing surface of the spray channel.

8. An actuator mechanism according to claim 1 characterised in that the slider is moulded from a different material from the over-cap.

9. An actuator mechanism according to claim 6, characterised in that the spring at its other end is located in place by a constraint depending from the underside of the top wall of the over-cap.

10. An actuator mechanism according to claim 1 characterised in that the spring and keel occupy parallel longitudinal slits.

11. An actuator mechanism according to claim 10 characterised in that one of the spring and keel occupy a longitudinal slit along the axis of the spray aperture and valve and the other is laterally offset.

12. An actuator mechanism according to claim 1 characterised in that two symmetrically positioned offset springs or keels are present.

13. An actuator mechanism according to claim 1 characterised in that twin offset keels are employed.

14. An actuator mechanism according to claim 1 wherein the over-cap has on its top surface a shallow indent dimensioned to accommodate the finger plate when it is moved from a valve disengaged position to a valve-engaged position.

15. An actuator mechanism according to claim 14 characterised in that the shallow indent is attached to the topwall of the over-cap along its front and side edges.

16. An actuator mechanism according to claim 14 characterised in that the shallow indent is attached to the topwall of the over-cap along its rear edge and separated from the topwall along its front and side edges.

17. An actuator mechanism according to claim 1 characterised in that the valve is axially opening and when the slider has reached the valve-engagable position, its keel is located above the valve and depresses the valve by depression of the slider.

18. An actuator mechanism according to claim 16 characterised in that the over-cap comprises an inclined ramp forward of the valve and underneath the longitudinally extending slit which ramp terminates at its front end in a well and the slider comprises a follower for the ramp positioned forward of the valve, whereby when the follower reaches the well, the keel of the slider is spaced above or in contact with the spray channel so that depression of the slider depresses the spray channel and opens the valve.

19. An actuator mechanism according to claim 1 characterised in that the valve is axially opening and the slider is provided with a keep profiled such that forward movement of the slider to the valve-engagable position causes the keep to depress and open the valve.

20. An actuator mechanism according to claim 1 characterised in that the valve is a tilt valve and forward movement of the slider to the valve-engaged position, causes the keep to tilt and open the valve.

21. An actuator mechanism according to claim 1 characterised in that when in the valve-disengaged position, the slider has lock means releasable by finger pressure.

22. An actuator mechanism according to claim 21 characterised in that the lock means comprises mating boss and receiver, the one on the slider and the other on the over-cap.

23. An actuator mechanism according to claim 22 characterised in that the boss depends from the slider and the receiver comprises an aperture or dimple in the over-cap.

24. An actuator mechanism according to claim 21 characterised in that the lock means comprises a pair of mating bosses and receivers, preferably symmetrically positioned and offset from the longitudinal axis extending through the spray aperture.

25. An actuator mechanism according to claim 1 characterised in that the over-cap inclines from front to rear.

26. An actuator mechanism according to claim 25 characterised in that the angle of inclination of the over-cap to the horizontal is from 30 to 35°.

* * * * *